United States Patent [19]

van Vliet

[11] 4,146,813

[45] Mar. 27, 1979

[54] HIGH-PRESSURE SODIUM VAPOR DISCHARGE LAMP

[75] Inventor: Johannes A. J. M. van Vliet, Eindhoven, Netherlands

[73] Assignee: U.S. Philips Corporation, New York, N.Y.

[21] Appl. No.: 891,635

[22] Filed: Mar. 30, 1978

[30] Foreign Application Priority Data

Apr. 15, 1977 [NL] Netherlands ..... 7704132

[51] Int. Cl.[2] ..... H01J 61/12

[52] U.S. Cl. ..... 313/184; 313/185; 313/214; 313/225

[58] Field of Search ..... 313/184, 185, 214, 225

[56] References Cited

U.S. PATENT DOCUMENTS 4,039,880 8/1977 Beijer et al. ..... 313/225 X

*Primary Examiner*—Rudolph V. Rolinec
*Assistant Examiner*—Darwin R. Hostetter
*Attorney, Agent, or Firm*—Thomas A. Briody; Robert S. Smith

[57] ABSTRACT

The invention relates to a high-pressure sodium vapor discharge lamp comprising a discharge tube containing sodium and xenon.

In accordance with the invention the inside diameter of the discharge tube is below 5 mm and greater than 1 mm. In addition the xenon pressure is relatively high in the operating condition of the lamp which — together with a pressure of the sodium in a given range — can result in a high luminous efficacy of the lamp.

3 Claims, 1 Drawing Figure

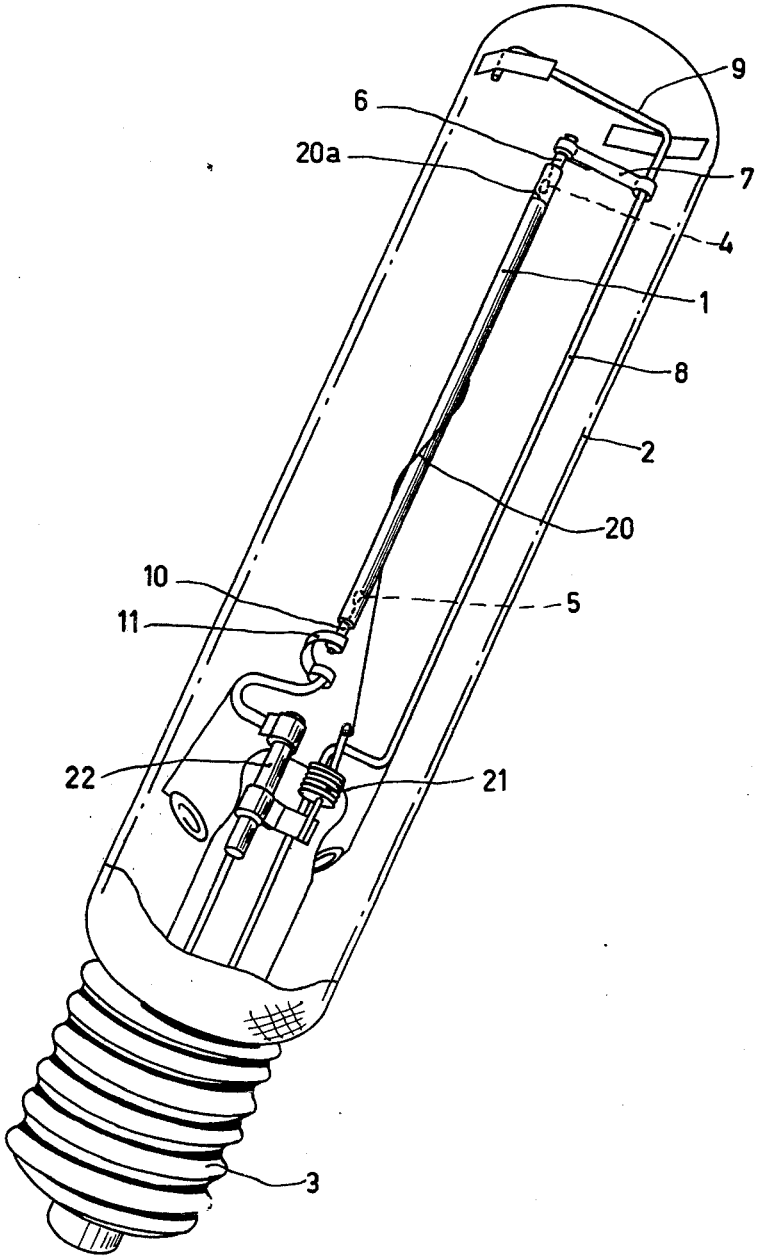
9
6
20a
7
4
1
8
2
20
10
5
11
22
21
3

HIGH-PRESSURE SODIUM VAPOR DISCHARGE LAMP

The invention relates to a high-pressure sodium vapour discharge lamp comprising a discharge tube containing xenon as well as sodium, the discharge tube having a circle-cylindrical shape and the discharge tube being provided at each end with a respective internal electrode and wherein:

$$P_{xenon} > P_{sodium}$$

where $P_{xenon}$ represents the pressure in Torr of the xenon in the discharge tube at 300° Kelvin and $P_{sodium}$ the sodium vapour pressure in Torr in the discharge tube during the operating condition of the lamp.

A prior art high-pressure sodium vapour discharge lamp of the type defined above is, for example, disclosed in U.S. Pat. No. 3,248,590. In an embodiment of that known lamp only the xenon gas functions as buffer gas.

The discharge tube of that known lamp has a relatively large inside diameter, namely 6 millimeters. This is a drawback, as will be discussed hereinafter.

The luminous efficacy, for example expressed in lumens per watt, of a lamp of the type defined above is determined inter alia by the pressure of the xenon gas in the discharge tube in the operating condition of the lamp and by the wall material and the wall thickness of that discharge tube. Aluminium oxide is often used — owing to the corrosive character of sodium — as the wall material. With a relatively large inside diameter of the discharge tube — as in the indicated known lamp — the maximum xenon pressure is only rather low. High xenon pressures result, in the case of a large inside discharge tube diameter, either in a situation in which the discharge tube is mechanically too weak or — when using a thicker wall for the discharge tube — in greater light absorption losses in the discharge tube wall.

The xenon pressure in the operating condition of the lamp is, of course, also determined by the average temperature $T_b$ in degrees Kelvin of the discharge tube of that lamp in that operating condition. Therefore, if the (cold) pressure, at 300° Kelvin — namely at room temperature — of the xenon in the discharge tube is, for example, x Torr, then the pressure of the xenon in the operating condition is approximately $x.(T_b/300)$ Torr. With a typical $T_b$ of approximately 2400° Kelvin the xenon pressure in the operating condition of the lamp is therefore approximately 8x Torr.

It is an object of the invention to indicate, for a high-pressure sodium vapour discharge lamp of the type defined above, how the xenon pressure can be chosen relatively high, and that so that, also in combination with other parameters, a high luminous efficacy can be realised with a mechanically sufficiently strong discharge tube.

A high-pressure sodium vapour discharge lamp according to the invention, comprising a discharge tube containing xenon as well as sodium, the discharge tube having a circle-cylindrical shape, the discharge tube being provided at each end with a respective internal electrode and wherein $$P_{xenon} > P_{sodium},$$

where $P_{xenon}$ represents the pressure in Torr of the xenon in the discharge tube at 300° Kelvin and $P_{sodium}$ represents the sodium vapour pressure in Torr in the discharge tube during the operating condition of the lamp, is characterized in that $$(240/\sqrt{d}) < P_{sodium} < (360/\sqrt{d})$$

and $$1.25 < (P_{xenon}/P_{sodium}) < 6$$

and in that $1 < d < 5$ where: d is the inside diameter (in mm) of the discharge tube.

An advantage of a high-pressure sodium vapour discharge lamp according to the invention is that when the construction of the discharge tube is mechanically sufficiently strong — by the choice of the small inside discharge tube diameter — the luminous efficacy can be high since higher pressure can be used. With an inside discharge tube diameter below 1 mm there is the drawback that the heat losses of the discharge become so great that the efficiency of the light production is unacceptably low.

It should be noted that with sodium vapour pressures above the range specified therefor the spectral composition of the light emitted by the lamp deviates too much from the required spectral luminous efficiency curve so that the luminous efficacy of the lamp is adversely affected. With sodium vapour pressures below the range specified therefor the efficiency of the arc discharge in the discharge tube strongly decreases at high xenon pressures.

Starting from the above-mentioned maximum inside diameter of 5 mm of the discharge tube, when the inside diameter is reduced to below 5 mm the so called heat conduction losses increase. By, however, choosing, in accordance with the invention, the xenon pressure in the discharge tube to be high, the heat conduction losses are reduced. Choosing a smaller inside diameter of the discharge tube consequently renders a higher pressure of the xenon buffer gas both possible and desirable. The reduction in the above-mentioned heat conduction losses in the discharge, by the addition of xenon gas, is caused by the poor heat conduction of xenon.

A xenon pressure at 300° Kelvin exceeding the sodium vapour pressure in the operating condition of the lamp by a factor of more than 6, which implies that the xenon pressure in the operating condition of the lamp exceeds the sodium pressure by, for example, more than a factor of 50, has the drawback that the required starting voltage of the lamp becomes unacceptably high and is not compensated by the increase in the luminous efficacy.

It should be noted that a high-pressure sodium vapour discharge lamp comprising a discharge tube which contains xenon as well as sodium, the pressure of the xenon being greater in the operating condition of the lamp than that of the sodium, is known per se from Dutch Patent Application 7500551. However, that known lamp also has the drawback of a relatively large inside diameter of the discharge tube — of more than 6 mm — and, in addition, the relatively low sodium vapour pressure of less than 70 Torr.

U.S. Pat. No. 3,906,272 also discloses a high-pressure sodium vapour discharge lamp comprising a discharge tube having an inside diameter which is, it is true, below 5 mm, but which has a low xenon pressure, so that in that lamp the xenon functions as a starting gas only.

With a preferred embodiment of a high-pressure sodium vapour discharge lamp according to the invention:

$$2.5\sqrt{W}/V < d < 3.1\sqrt{W}/V$$

where:

W represents the power in watts of the discharge tube in the operating condition; and V is the operating voltage in volts of that discharge tube in the operating condition of the lamp.

An advantage of that preferred embodiment is that the thermal wall load, for example expressed in watts per $cm_2$ of the inside discharge tube surface, can then be given an acceptable value, for example when aluminium oxide is used as material for the wall of the discharge tube.

A further improvement of that preferred embodiment of a high-pressure sodium vapour discharge lamp according to the invention also satisfies the condition:

$$0.54\sqrt{W}.V < A < 0.66\sqrt{W}.V,$$

where A represents the spacing in mm between the two electrodes of the discharge tube.

An advantage of this improvement is that, where the value of the desired power — in watts — or of the desired operating voltage of the lamp is already fixed, an optimum electrode spacing is obtained with this preferred embodiment.

Embodiments of the invention will now be further explained with reference to the drawing which shows a perspective view of a high-pressure sodium vapour discharge lamp according to the invention.

In the drawing reference 1 represents a discharge tube whose wall consists of densely sintered aluminium oxide. This tube is arranged in an outer bulb 2. Reference 3 indicates a base of the lamp. The discharge tube 1 is provided with two internal main electrodes 4 and 5 respectively, which are arranged near the ends of this discharge tube. The main electrode 4 is connected to a metal strip 7 via a feedthrough 6. This strip 7 is connected to a pole wire 8. The major portion of this pole wire 8 is parallel to the discharge tube 1. This pole wire is electrically connected to a contact of the base 3 of the lamp. An extended portion 9 of the pole wire 8 is used to support and center the discharge tube 1 in the outer bulb 2. The main electrode 5 is connected through a tubular feedthrough 10 to a metal conductor strip 11. The other end of this strip 11 is electrically connected to another contact in the base 3 of the lamp.

In addition the discharge tube is provided with an external auxiliary electrode 20, which is wound around that tube. This auxiliary electrode 20 is fastened near the main electrode 4 to the discharge tube 1 by means of a wire loop 20*a*. At the other end of the discharge tube this starting electrode 20 is connected to a tension spring 21. The other end of this spring 21 is electrically connected to a capacitor 22 disposed in the space between the discharge tube 1 and the outer bulb 2. The other end of the capacitor 22 is connected to the metal strip 11 leading to the main electrode 5 of the discharge tube 1.

The spring 21 subjects the auxiliary electrode 20 to a tensile load. This will cause the auxiliary electrode to be held in close contact with the outer wall of the discharge tube 1 at all times.

The filling of discharge tube 1 comprises sodium and xenon. The space between the discharge tube 1 and the outer bulb 2 is evacuated.

The described lamp is, for example, started with a starter (not shown) provided with a thyristor, for example as indicated in Dutch Patent Application No. 6904456. In the operating condition, the described lamp is connected through an inductive stabilisation impedance of approximately 0.5 Henry to an a.c. supply mains of approximately 220 volt, 50 Hz. Further details of the described lamp are included in the following Table.

The temperature of the coldest spot in the discharge tube 1 is — in the operating condition of the lamp according to the invention — approximately 1020° Kelvin. A sodium vapour pressure in the discharge tube of approximately 170 Torr corresponds therewith. The average temperature of the discharge tube 1 is approximately 2400° Kelvin in the operating condition of the lamp.

The dimensions etc. as well as other data concerning the described lamp are specified in the column (I) of the Table. Column (II) shows details regarding a second high-pressure sodium vapour discharge lamp according to the invention.

TABLE

| | I | II |
|---|---|---|
| Power W (in watts): | 100 | 70 |
| Operating voltage V (in volts): | 100 | 100 |
| Current strength (in ampers): | 1.09 | 0.77 |
| Inside diameter d of the discharge tube (in mm): | 2.75 | 2.35 |
| Wall thickness of the discharge tube (in mm): | 0.6 | 0.6 |
| Spacing of the main electrodes (in mm): (A) | 60 | 50 |
| Weight of the sodium in the discharge tube (in mgram): | 3 | 3 |
| $P_{sodium}$ in the operating condition (in Torr): | 170 | 180 |
| $P_{xenon\ cold}$ (in Torr): | 375 | 400 |
| $P_{xenon}$ in the operating condition (in Torr): | 3000 | 3200 |
| Luminous efficacy (lumens/watt): | 105 | 97 |

This Table shows that in the first example (I) the following conditions are satisfied:

(1) Xenon pressure at room temperature, namely at 300° Kelvin < $P_{sodium}$ (in the operating condition) namely 375 Torr relative to 170 Torr.

(2) The inside diameter d of the discharge tube is between 1 and 5 mm, namely d is 2.75 mm.

(3) $P_{sodium}$ in the operating condition is between:

$$240/\sqrt{d} \text{ and } 360/\sqrt{d}$$

$P_{sodium}$ is namely: 170 Torr, and $$240/\sqrt{d} = 240/\sqrt{2.75} = 145 \text{ and}$$

$$360/\sqrt{d} = 360/\sqrt{2.75} = 217.$$

(4) 1.25

$$< (P_{xenon}/P_{sodium}) < 6$$

For, $P_{xenon}/P_{sodium}$ is, in the described lamp in accordance with the invention:

$$375/170 = 2.2.$$

(5) Also satisfied is:

$$2.5\sqrt{W}/V < d < 3.1\sqrt{W}/V$$

for d = 2.75 and $$2.5\sqrt{W}/V = 2.5 \text{ and}$$

$$3.1\sqrt{W}/V = 3.1.$$

(6) Finally it is satisfied that:

$$0.54\sqrt{W}.V < A < 0.66\sqrt{W}.V$$

since, A = 60 and $$0.54\sqrt{W}.V. = 54 \text{ and}$$

$$0.66\sqrt{W}.V. = 66.$$

It can be seen in a similar manner that example II of the Table also satisfies the conditions 1 to 4 imposed.

In the two indicated embodiments of lamps according to the invention the high luminous efficacy must also be attributed to the favourable spectral distribution of the emitted light obtained with the relatively small diameter of the discharge tube and the rather high sodium and xenon pressures used therewith.

What is claimed is:

1. A high-pressure sodium vapour discharge lamp comprising a discharge tube containing xenon as well as sodium, the discharge tube having a circle-cylindrical shape, the discharge tube being provided at each end with a respective internal electrode, and wherein $$P_{xenon} > P_{sodium}$$

where $P_{xenon}$ represents the pressure in Torr of the xenon in the discharge tube at 300° Kelvin and $P_{sodium}$ represents the sodium vapour pressure in Torr in the discharge tube during the operating condition of the lamp, characterized in that $$240/\sqrt{d} < P_{sodium} < 360/\sqrt{d}$$

and $$1.25 < P_{xenon}/P_{sodium} < 6$$

and in that $1 < d < 5$
where d is the inside diameter (in mm) of the discharge tube.

2. A high-pressure sodium vapour discharge lamp as claimed in claim 1, characterized in that $$2.5\sqrt{W}/V < d < 3.1\sqrt{W}/V$$

where W represents the power in watts of the discharge tube in the operating condition of the lamp; and V is the operating voltage in volts of that discharge tube in the operating condition of the lamp.

3. A high-pressure sodium vapour discharge lamp as claimed in claim 2, characterized in that $$0.54\sqrt{W}.V. < A < 0.66\sqrt{W}.V.$$

where A represents the spacing in mm between the two electrodes of the discharge tube.

* * * * *